US008484966B2

(12) United States Patent
Rasmussen et al.

(10) Patent No.: US 8,484,966 B2
(45) Date of Patent: Jul. 16, 2013

(54) ROTARY HEAT EXCHANGER

(75) Inventors: Eric K. Rasmussen, Overland Park, KS (US); Jidong Yang, Overland Park, KS (US); Hobart Cox, Greenwod, MO (US)

(73) Assignee: SPX Corporation, Charlotte, NC (US)

( * ) Notice: Subject to any disclaimer, the term of this patent is extended or adjusted under 35 U.S.C. 154(b) by 545 days.

(21) Appl. No.: 12/772,349

(22) Filed: May 3, 2010

(65) Prior Publication Data

US 2011/0265837 A1 Nov. 3, 2011

(51) Int. Cl.

| | |
|---|---|
| ***A47J 39/00*** | (2006.01) |
| ***F25B 29/00*** | (2006.01) |
| ***F25B 9/00*** | (2006.01) |
| ***A23C 3/02*** | (2006.01) |
| ***F01B 29/10*** | (2006.01) |
| ***F02G 1/04*** | (2006.01) |

(52) U.S. Cl.
USPC ..... 60/517; 62/6; 165/201; 165/61; 165/66

(58) Field of Classification Search
USPC ..... 60/516–526, 670; 165/88–90, 201, 165/66; 62/6
See application file for complete search history.

(56) References Cited

U.S. PATENT DOCUMENTS

| | | | | |
|---|---|---|---|---|
| 3,791,369 | A * | 2/1974 | Des Champs | 126/116 R |
| 4,107,944 | A * | 8/1978 | Eskeli | 62/401 |
| 4,290,267 | A | 9/1981 | Buchner | |
| 4,512,150 | A * | 4/1985 | Benson | 60/526 |
| 4,520,632 | A * | 6/1985 | Dibrell | 62/403 |
| 4,852,642 | A * | 8/1989 | Lee | 165/109.1 |
| 5,771,707 | A * | 6/1998 | Lagace et al. | 62/271 |
| 6,365,822 | B1 * | 4/2002 | Dobry et al. | 136/202 |
| 2005/0006059 | A1 * | 1/2005 | Tarasinski | 165/90 |
| 2007/0186554 | A1 | 8/2007 | Miroslav | |
| 2008/0035195 | A1 * | 2/2008 | Bell | 136/206 |
| 2009/0224546 | A1 * | 9/2009 | Davidson | 290/52 |

FOREIGN PATENT DOCUMENTS

| | | |
|---|---|---|
| GB | 1444206 | 7/1976 |
| WO | 2004/019379 A2 | 3/2004 |

OTHER PUBLICATIONS

International Search Report and Written Opinion for PCT/US2011/034874, completed Jul. 24, 2011.

* cited by examiner

*Primary Examiner* — Thomas Denion
*Assistant Examiner* — Brian Inacay
(74) *Attorney, Agent, or Firm* — Baker & Hostetler LLP

(57) ABSTRACT

A system for generating power from a low grade heat source includes a heat source inlet, heat sink inlet, heat exchanger unit, and a heat engine. The heat source inlet conveys a flow of a heated fluid into the system. The heat sink inlet conveys a flow of a cooled fluid into the system. The heat exchanger unit is configured to rotate. A portion of the heat exchanger unit alternates between thermal contact with the heated fluid and thermal contact with the cooled fluid in response to being rotated. The heat engine is configured to generate power in response to the heat exchanger unit being rotated.

35 Claims, 7 Drawing Sheets

Iso View

Cutaway View

SECTION 6-6

ROTARY HEAT EXCHANGER

FIELD OF THE INVENTION

The present invention generally relates to a rotating heat exchanger. More particularly, the present invention pertains to a rotating heat exchanger for use with a device to extract energy from a temperature differential.

BACKGROUND OF THE INVENTION

In 2007, U.S. coal, nuclear and natural gas fueled power plants generated 3,700 billion kilowatt hours (kWh) of electricity. All of these power plants utilize a heat source to generate high pressure, super heated steam to rotate a steam turbine. In general, to function properly, steam turbines require steam on the order of 300° C. to 500° C. and 3 to 8 mega Pascals (Mpa) of pressure. However, after all usable heat energy has been extracted by the turbines, a significant amount of 'low-grade waste heat' remains—most of which is expelled into the environment via cooling towers, rivers or the ocean. In 2007, these power plants produced nearly 6,837 billion kWh of low-grade waste heat. Unfortunately, while a variety of energy generating systems have been proposed to make use of this low-grade heat, none of these systems have proven to be economically feasible.

In addition, even in situations in which higher temperature differentials are available, conventional heat engines suffer from a number of disadvantages. Specifically, conventional heat engines typically include complex mechanical and control systems that are expensive to build and maintain.

Accordingly, it is desirable to provide a system and device capable of overcoming the disadvantages described herein at least to some extent.

SUMMARY OF THE INVENTION

The foregoing needs are met, to a great extent, by the present invention, wherein in one respect a device and system to simplify the extraction of energy from a temperature differential is provided.

An embodiment of the present invention pertains to a system for generating power from a low grade heat source. The system includes a heat source inlet, heat sink inlet, heat exchanger unit, and a heat engine. The heat source inlet conveys a flow of a heated fluid into the system. The heat sink inlet conveys a flow of a cooled fluid into the system. The heat exchanger unit is configured to rotate. A portion of the heat exchanger unit alternates between thermal contact with the heated fluid and thermal contact with the cooled fluid in response to being rotated. The heat engine is configured to generate power in response to the heat exchanger unit being rotated between the heat source and the heat sink.

Another embodiment of the present invention relates to a power plant having a system for generating power from a low grade heat source. This includes a heat source inlet, heat sink inlet, heat exchanger unit, and a heat engine. The heat source inlet conveys a flow of a heated fluid into the system. The heat sink inlet conveys a flow of a cooled fluid into the system. The heat exchanger unit is configured to rotate. A portion of the heat exchanger unit alternates between thermal contact with the heated fluid and thermal contact with the cooled fluid in response to being rotated. The heat engine is configured to generate power in response to the heat exchanger unit being rotated between the heat source and the heat sink.

Another embodiment of the present invention pertains to a heat exchanger. The heat exchanger unit includes a heat source, heat sink, and a plurality of conduits. The heat source inlet is to convey a flow of a heated fluid to the heat exchanger. The heat sink inlet is to convey a flow of a cooled fluid to the heat exchanger. The plurality of conduits are disposed about a central axis of the heat exchanger. The plurality of conduits are configured to rotate in unison about the central axis. Each of the plurality of conduits alternate between thermal contact with the heated fluid and thermal contact with the cooled fluid in response to being rotated and the plurality of conduits are configured for thermal contact with a heat engine configured to generate energy in response to rotation of the plurality of conduits.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides, in various embodiments, a rotary heat exchanger device and a system which utilizes the rotary heat exchanger device for generating energy across a relatively low temperature differential. For the purposes of this disclosure, the term, 'low temperature differential' refers to a temperature differential of about 1° C. to about 30° C. and the term, 'low-grade waste heat' refers to a heat source at about 35° C. to about 100° C. It is an advantage of one or more embodiments of the invention that the low-grade waste heat may be utilized to generate usable energy rather than being exhausted or rejected into the environment. In some embodiments, the rotary heat exchanger device is utilized to rotate a heat engine or a portion thereof between a heat source and a heat sink. In response to being subjected to the temperature differential between the heat source and the heat sink, the heat engine is configured to generate an amount of work. For the purposes of this disclosure, a heat engine includes any substance, device, or system capable of converting thermal energy into work. The work may be in the form of mechanical, electrical, or chemical energy. In general, suitable heat engines may operate by exploiting a chemical change, phase change, adsorption/desorption of a working fluid, thermoelectric material properties, and the like. Specific examples of suitable heat engines include a hydride compressor, sterling engine, thermoelectric generator, and the like. A particular example of a suitable hydride compressor includes a multistage hydride/hydrogen compressor or the like. The work output of the motor may be used directly and/or may be used to drive a generator.

Figure 1:
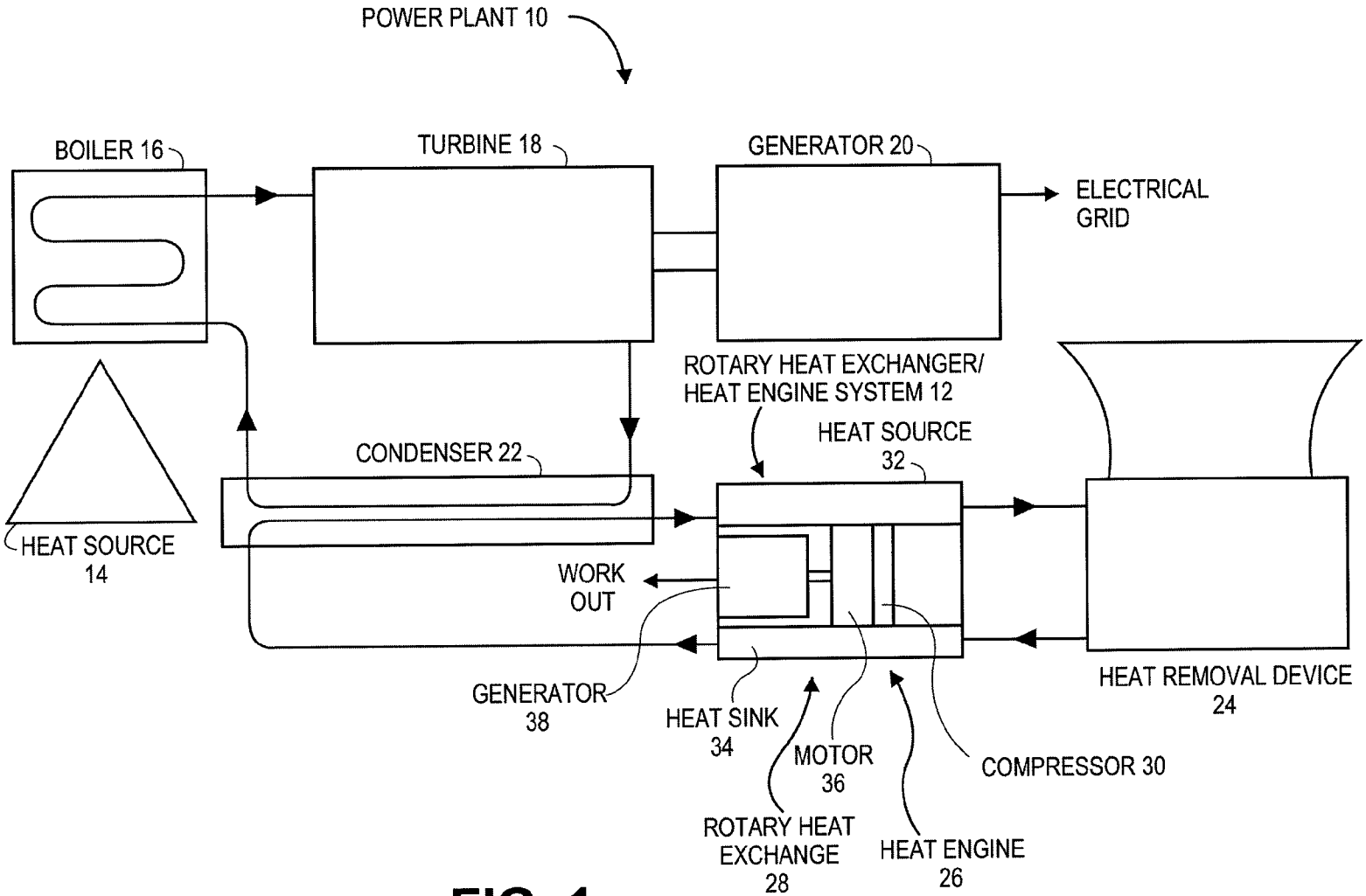
FIG. 1 is a simplified system diagram of a power generating facility with a rotary heat exchanger/heat engine system according to an embodiment of the invention.

Preferred embodiments of the invention will now be described with reference to the drawing figures, in which like reference numerals refer to like parts throughout. FIG. 1 is a simplified system diagram of a power generating facility or power plant 10 with a rotary heat exchanger/heat engine system 12 according to an embodiment of the invention. As a general matter, the power plant 10 includes a heat source 14, boiler 16, turbine 18, generator 20, condenser 22, and heat removal device 24. The heat source 14 may be provided via: the burning of a flammable material such as gas, oil, coal, or the like; nuclear fission; solar heating; and/or the like. Typically water is converted to high pressure/temperature steam in the boiler 16 and this steam is utilized to drive the turbine 18. In addition to this driving force, a partial vacuum may be generated via the condenser 22 to facilitate the movement of steam through the turbine 18, and thus, increasing the driving force delivered to the turbine 18. Rotation of the turbine 18 is utilized to rotate the generator 20 and generate electrical power. To cool the condenser 22, a flow of fluid is circulated between the condenser 22 and the heat removal device 24.

As shown in FIG. 1, the rotary heat exchanger/heat engine system 12 is generally disposed between the heat source 14 and the heat removal device 24. While any point between the heat source 14 and heat removal device 24 may be suitable for the rotary heat exchanger/heat engine system 12, a particularly suitable location for the rotary heat exchanger/heat engine system 12 is between the condenser 22 and the heat removal device 24. Generally, the heat dissipated by the heat removal device 24 is considered waste heat. Not only is this waste heat rejected as a potential generator of energy, approximately 0.5%-1% of the energy produced by a typical power plant is expended to remove the heat (e.g., to power pumps, fans, and the like). As such, it is particularly surprising that this waste heat serves as a suitable heat source for embodiments of the invention.

By way of example, in 2007, approximately 312,738 Megawatts (MW) of power was generated by coal-fired power plants in the United States. These coal-fired plants utilized the equivalent of 8486 cooling tower units. An embodiment of the present invention may be capable of producing 150 kilowatts (kW) of power per cooling tower unit or 1273 MW of additional power. Coal-fired plants emit approximately 2.11 pounds (lb) or 0.957 kilograms (kg) of $CO_2$ per kWh of electricity. Accordingly, implementing an embodiment of this invention in coal-fired plants alone would offset 6.9 million metric tons of $CO_2$ emissions. In terms of oil, this additional power is roughly equivalent to 10.9 million barrels of oil. These figures are based on coal-fired power generation in 2007 which may increase in the future. Furthermore, embodiments of the invention are suitable for use with other forms of power plants such as, for example, gas and oil-fired, nuclear, some forms of solar, and the like.

The rotary heat exchanger/heat engine system 12 according to a particular embodiment of the invention includes a heat engine 26 disposed within a rotary heat exchanger 28. The heat engine 26 includes any suitable heat engine. A particular example of a suitable heat engine includes a compressor 30 such as a metal hydride hydrogen compressor. A particular example of a suitable metal hydride hydrogen compressor is described in U.S. Pat. No. 5,623,987, titled MODULAR MANIFOLD GAS DELIVERY SYSTEM, the disclosure of which is incorporated herein in its entirety. The compressor 30 is configured to rotate relative to a heat source 32 and a heat sink 34. As described herein, by rotating the compressor 30 relative to the heat source 32 and the heat sink 34, one or more faces of the compressor 30 are subjected to a temperature that cycles between the temperature of the heat source 32 and the temperature of the heat sink 34. When cooled below a predetermined adsorption temperature, the metal hydride is configured to adsorb hydrogen gas. When warmed above a predetermined desorption temperature, the metal hydride is configured to release or desorb hydrogen. By configuring the metal hydride such that the predetermined adsorption temperature is above the temperature of the heat sink 34 and the predetermined desorption temperature is below the temperature of the heat source 32, hydrogen may be drawn in and expelled by rotating the compressor 30 relative to the heat source 32 and the heat sink 34. This creates a flow of relatively high pressure hydrogen between the metal hydride exposed to the heat source and the metal hydride exposed to the heat sink.

The metal hydride is disposed in a series of chambers, each chamber connected to the next via a one-way valve. In this manner, the pressure of the hydrogen may be increased stepwise at each chamber. For example, using a metal hydride configured to adsorb/release 2-3 volumes of hydrogen, the pressure may be increased from about 10 pounds per square inch (psi) (0.70 kilogram-force per square centimeter (kgf/$cm^2$)) to about 8000 psi (562 kgf/$cm^2$) in 6 to 10 stages. In a specific example using water at 122° F. (50° C.) as the heat source and returning water at 104° F. (40° C.) and having a total flow rate of about 2000 pounds/second (908 Liters/second), the pressure may be increased from about 550 psi (38.67 kgf/$cm^2$) to about 800 psi (56.25 kgf/$cm^2$) in about 3 to 5 stages.

This relatively high pressure hydrogen is supplied to a motor 36 to urge the motor 36 to rotate. Rotation of the motor 36 may be utilized directly, such as, for example to power a pump. In addition or alternatively, the rotation of the motor 36 may be utilized to turn a generator 38 configured to generate electricity.

Figure 2:
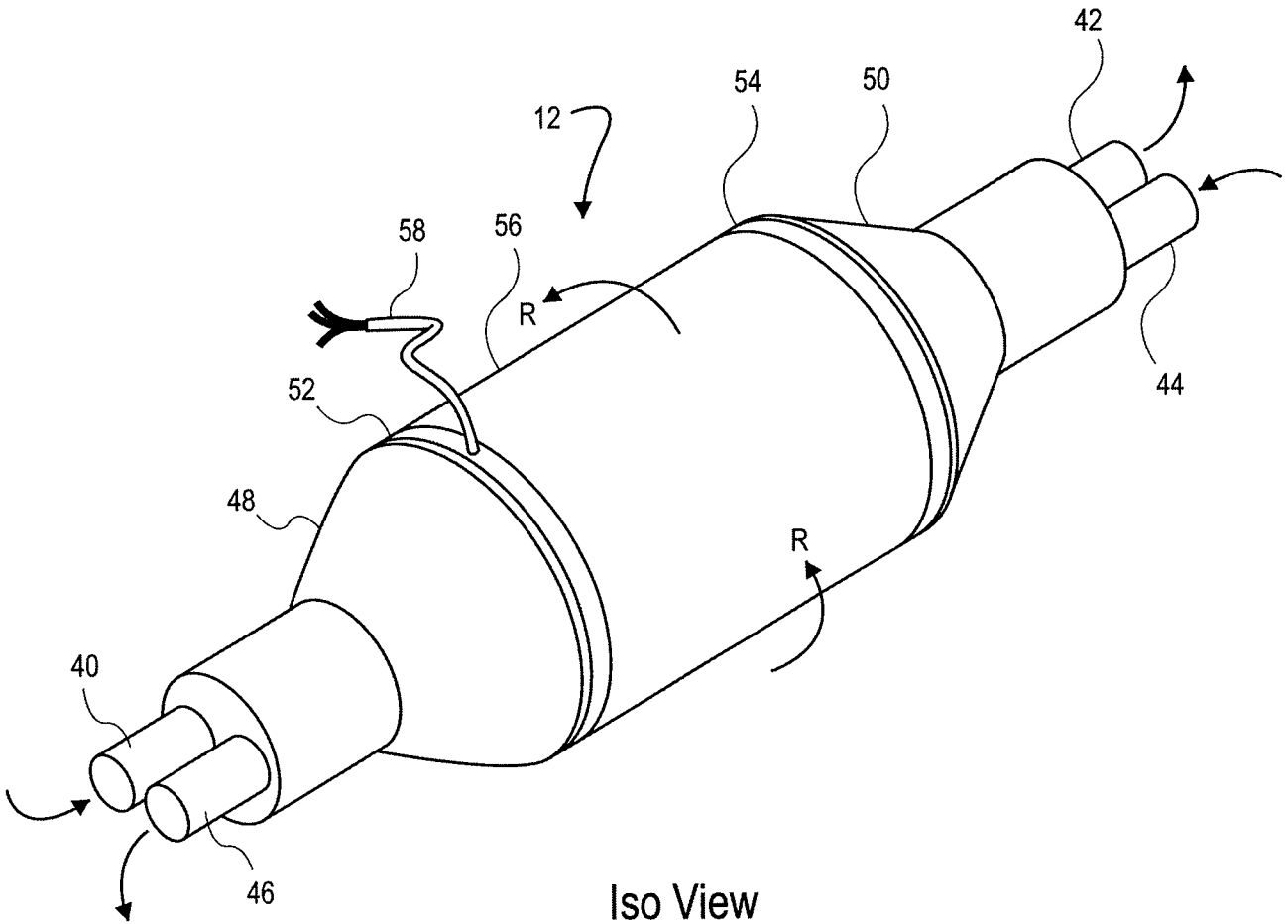
FIG. 2 is an isometric projection of the rotary heat exchanger/heat engine system of FIG. 1.

FIG. 2 is an isometric projection of the rotary heat exchanger/heat engine system 12 of FIG. 1. As shown in FIG. 2, the rotary heat exchanger/heat engine system 12 includes a heat source inlet 40, heat source outlet 42, heat sink inlet 44, and heat sink outlet 46. In addition, the rotary heat exchanger/heat engine system 12 includes a pair of distribution bells 48 and 50, a pair of diffuser rings 52 and 54, a rotating assembly 56, and a power line 58. In an embodiment of the invention, waste heat is introduced to the rotary heat exchanger/heat engine system 12 via a flow of hot fluid entering the heat source inlet 40. A flow of relatively cooler fluid serves as the heat sink 34 and is introduced via the heat sink inlet 44 and exits via the heat sink outlet 46. As described herein, the rotary heat exchanger 28 is urged to rotate relative to the flows of fluid serving as the heat source and the heat sink. In a particular example shown in FIG. 2, the rotating assembly 56 is urged to rotate in direction R. However, it is to be noted that the direction of rotation is inconsequential. Electricity generated by the rotary heat exchanger/heat engine system 12 is conveyed out of the rotary heat exchanger/heat engine system 12 via the power line 58.

Figure 3:
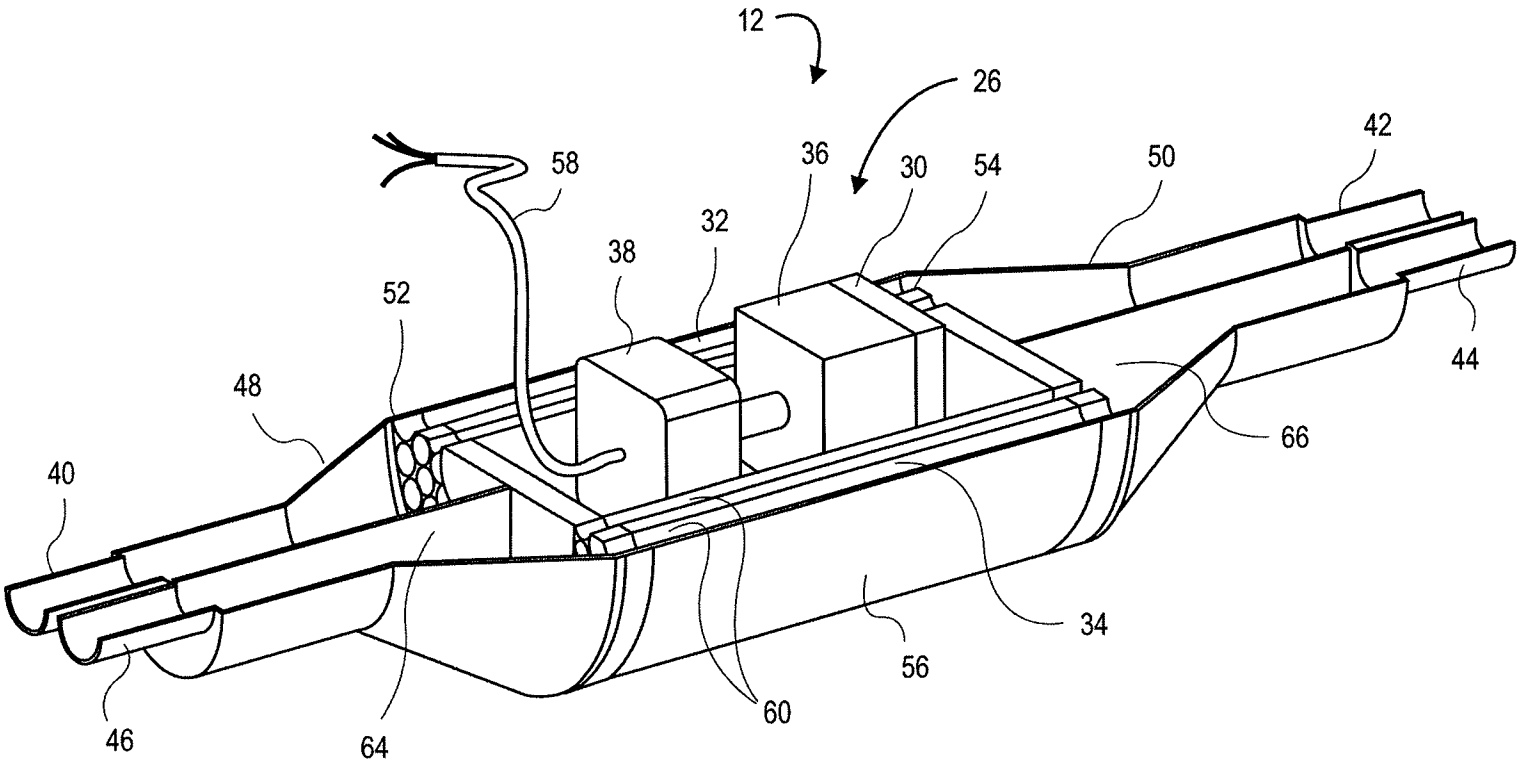
FIG. 3 is a cutaway view of the rotary heat exchanger/heat engine system of FIG. 1.

FIG. 3 is a cutaway view of the rotary heat exchanger/heat engine system 12 of FIG. 1. As shown in FIG. 3, the heat source 32 and heat sink 34 may include a plurality of conduits 60 configured to convey fluid therethrough. The plurality of conduits 60 are connected to the compressor 30. As the rotary heat exchanger 28 rotates, a portion of the plurality of conduits 60 become aligned between the heat source inlet 40 and the heat source outlet 42 and are heated by the flow of relatively hotter fluid flowing therethrough. As the rotating assembly 56 continues to rotate, this portion of the plurality of conduits 60 then become aligned between the heat sink inlet 44 and the heat sink outlet 46 and are cooled by the flow of relatively cooler fluid flowing therethrough. In general, the heat engine 26 is configured to utilize this cyclic heating and cooling to drive a thermodynamic process and thus generate work. In a particular example, the metal hydride chambers that form the stages of the multi-stage hydrogen compressor may be disposed within the plurality of conduits 60, may be disposed on the plurality of conduits 60, and/or may otherwise be thermally connected to the plurality of conduits 60.

To increase the surface area exposed to the flow of relatively hotter and cooler fluid, the plurality of conduits 60 are arranged at a perimeter of the generally cylindrically shaped rotating assembly 56. The distribution bells 48 and 50 direct the flow from/to the respective supply/outlet conduits. In a particular example, the distribution bells 48 and 50 increase the cross-sectional area of the supply/outlet conduits sufficiently to cover the diffuser rings 52 and 54. To isolate the flow of relatively hot fluid from the flow of relatively cool fluid, a partition 64 and 66 may be disposed respectively within the distribution bells 48 and 50. In another example, a plurality of manifold assemblies or the like may replace the distribution bells 48 and 50. For example, an inlet pipe may branch into several or a multitude of pipes that connect with ports disposed in the diffuser rings 52 or 54.

The diffuser rings 52 and 54 facilitate a smooth transition of flow from the distribution bells 48 and 50 to the plurality of conduits 60. In addition, as further described herein, the diffuser rings 52 and 54 may be configured to impart an angular momentum on the flow of fluid to urge the heat exchanger unit to rotate.

Various embodiments of the invention enjoy many advantages over conventional power generating systems. Some of these advantages include: 1) ability to generate power from heat sources conventionally viewed as 'waste heat'; 2) reduction of mechanical complexity; 3) reduction or elimination of electro/mechanical control systems; 4) improved reliability; 5) provides direct rotational force and thus eliminates reciprocal movement; and 6) ability to operate at extremely high flow rates. In addition, it is to be noted that although particular examples of the inventive rotary heat exchanger/heat engine system 12 are capable of generating power from waste heat (e.g., low $\Delta T$), in other examples, the rotary heat exchanger/heat engine system 12 is capable of generating power from relatively higher $\Delta T$ sources. When utilizing these relatively higher $\Delta T$ sources, the various embodiments of the invention continue to enjoy the benefits described herein.

Figure 4:
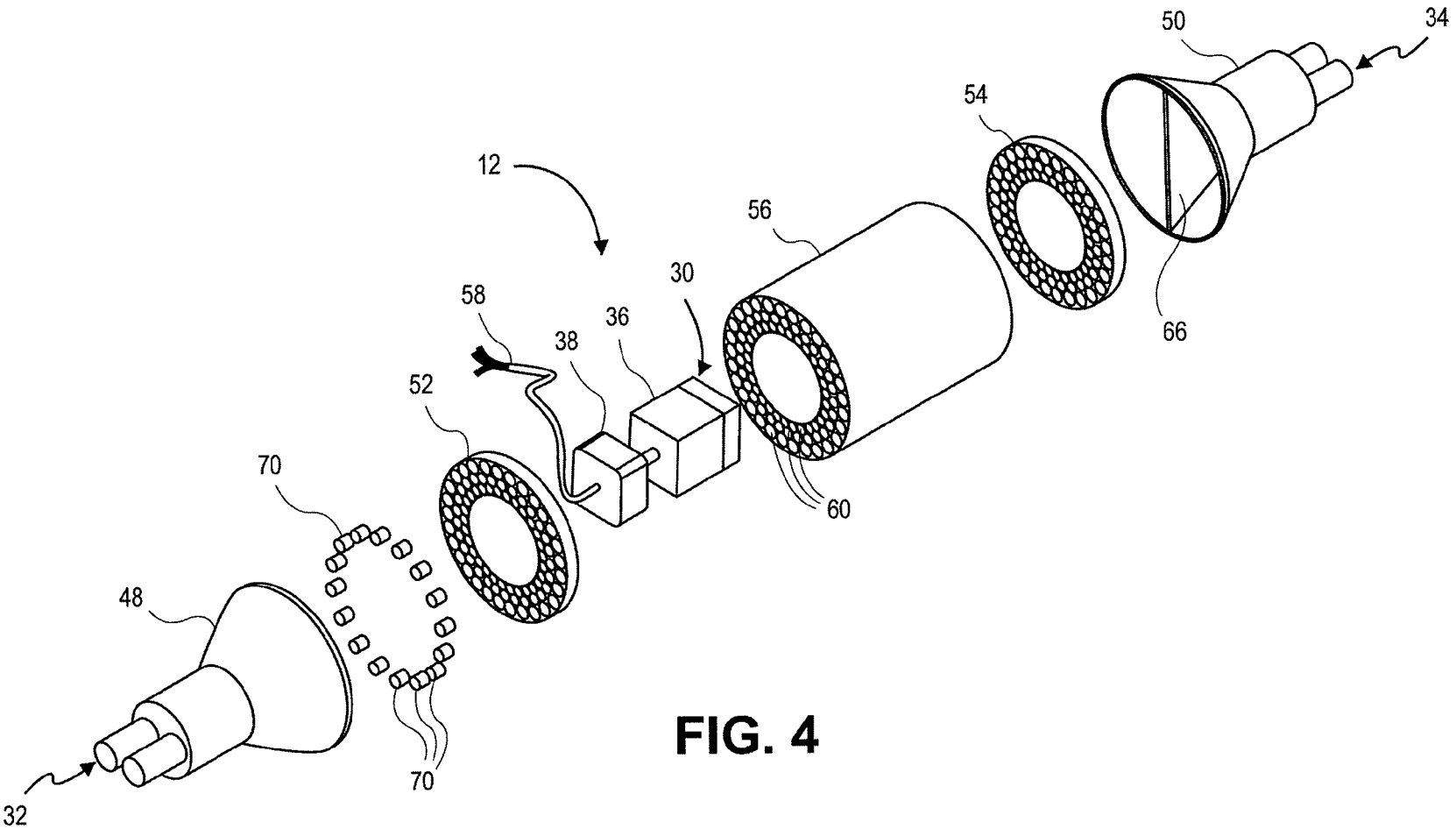
FIG. 4 is an exploded view of the rotary heat exchanger/heat engine system of FIG. 1.

FIG. 4 is an exploded view of the rotary heat exchanger/heat engine system 12 of FIG. 1. As shown in FIG. 4, the rotary heat exchanger/heat engine system 12 may include one or more turning vanes 70. If included, the turning vanes 70 may be configured to impart an angular momentum on the flow of fluid sufficient to urge the rotary heat exchanger 28 to rotate. By varying an angle of the turning vanes 70 and/or modulating the volume and/or velocity of the fluid flow, a rate at which the rotary heat exchanger 28 rotates may be varied. In general, the rotation rate of the rotating assembly 56 may be determined based upon the thermal response of the rotary heat exchanger 28 and/or compressor 30 and the adsorption/release rate of the metal hydride. However, in other examples, the turning vanes 70 may be omitted. For example, a portion of the work generated by the heat engine 26 may be utilized to rotate the rotating assembly 56 via one or more gears, an electric motor, and/or the like. In this manner, the rotary heat exchanger/heat engine system 12 may have a reduced effect upon the flow rate of fluid flowing through the heat source 32 and/or heat sink 34.

Figure 5:
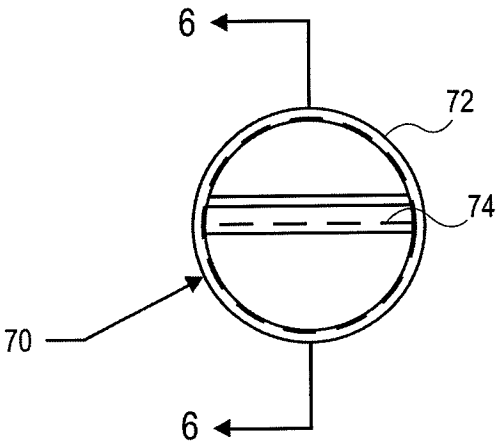
FIG. 5 is a front view of a turning vane suitable for use with the rotary heat exchanger/heat engine system of FIG. 1.

FIG. 5 is a front view of the turning vane 70 suitable for use with the rotary heat exchanger/heat engine system 12 of FIG. 1. As shown in FIG. 5, the turning vane 70 may include a cylindrical tube 72 and a vane 74 disposed at an angle within the tube 72.

Figure 6:
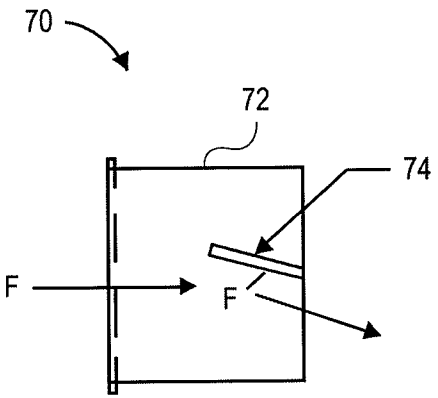
FIG. 6 is a cross sectional view of the turning vane of FIG. 5.

FIG. 6 is a cross sectional view 6-6 of the turning vane 70 of FIG. 5. As shown in FIG. 6, the vane 74 is configured to direct an incoming flow F of fluid in direction F'. By arranging the turning vanes 70 in a complimentary fashion, a force sufficient to urge the rotary heat exchanger 28 to rotate may be produced.

Figure 7:
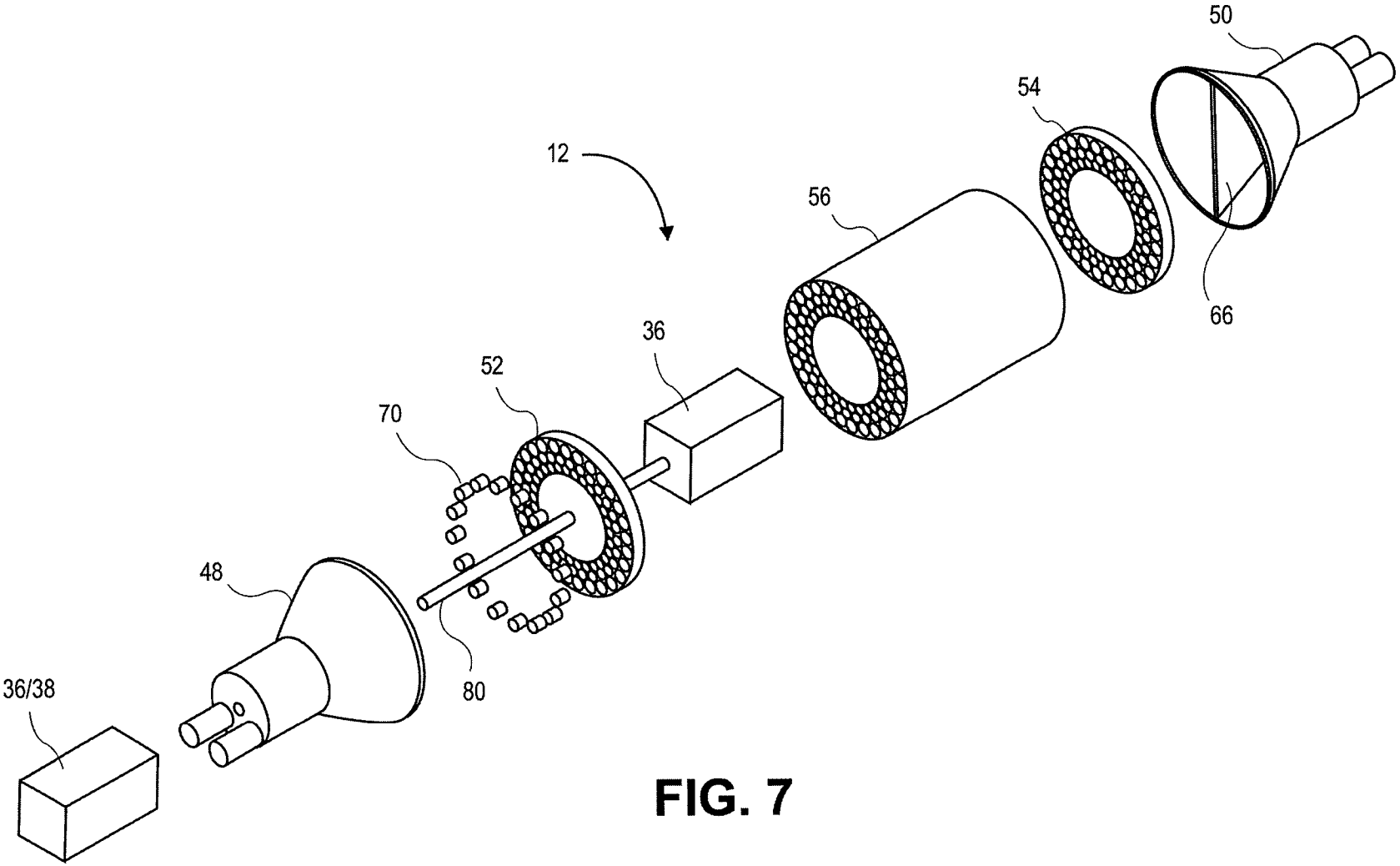
FIG. 7 is an exploded view of a rotary heat exchanger/heat engine system in accordance with another embodiment.

FIG. 7 is an exploded view of a rotary heat exchanger/heat engine system 12 in accordance with another embodiment. The rotary heat exchanger/heat engine system 12 according to FIG. 7 is similar to the rotary heat exchanger/heat engine system 12 shown in FIGS. 1-6 and thus, for the purpose of brevity, those elements already described hereinabove will not be described again. In general, the rotary heat exchanger/heat engine system 12 of this embodiment differs from the embodiment of FIG. 1 in that one or more components are moved out from the cylindrical rotary heat exchanger 28. As shown in FIG. 7, the rotary heat exchanger/heat engine system 12 includes a shaft 80 extending out of the rotary heat exchanger 28 along a central axis of the rotary heat exchanger 28. In various embodiments, the shaft 80 may be configured to convey a flow of hydrogen or transmit torque. For example, the shaft 80 may include a set of conduits—a first conduit to convey high pressure hydrogen from the compressor 30 and a second conduit to return relatively lower pressure hydrogen to the compressor 30. Alternatively, the shaft 80 may provide an output for the motor 36. The shaft 80 may continue through the diffuser ring 52 and distribution bell 48.

In various examples, the motor 36 and/or the generator 38 may be secured to the shaft 80 to receive the output of the compressor 30 and/or the motor 36. In a particular example, the motor 36 is disposed in the rotary heat exchanger 28 and the shaft 80 transmits torque generated by the motor 36 to the generator 38 and/or a pump disposed outside the rotary heat exchanger 28.

Figure 8:
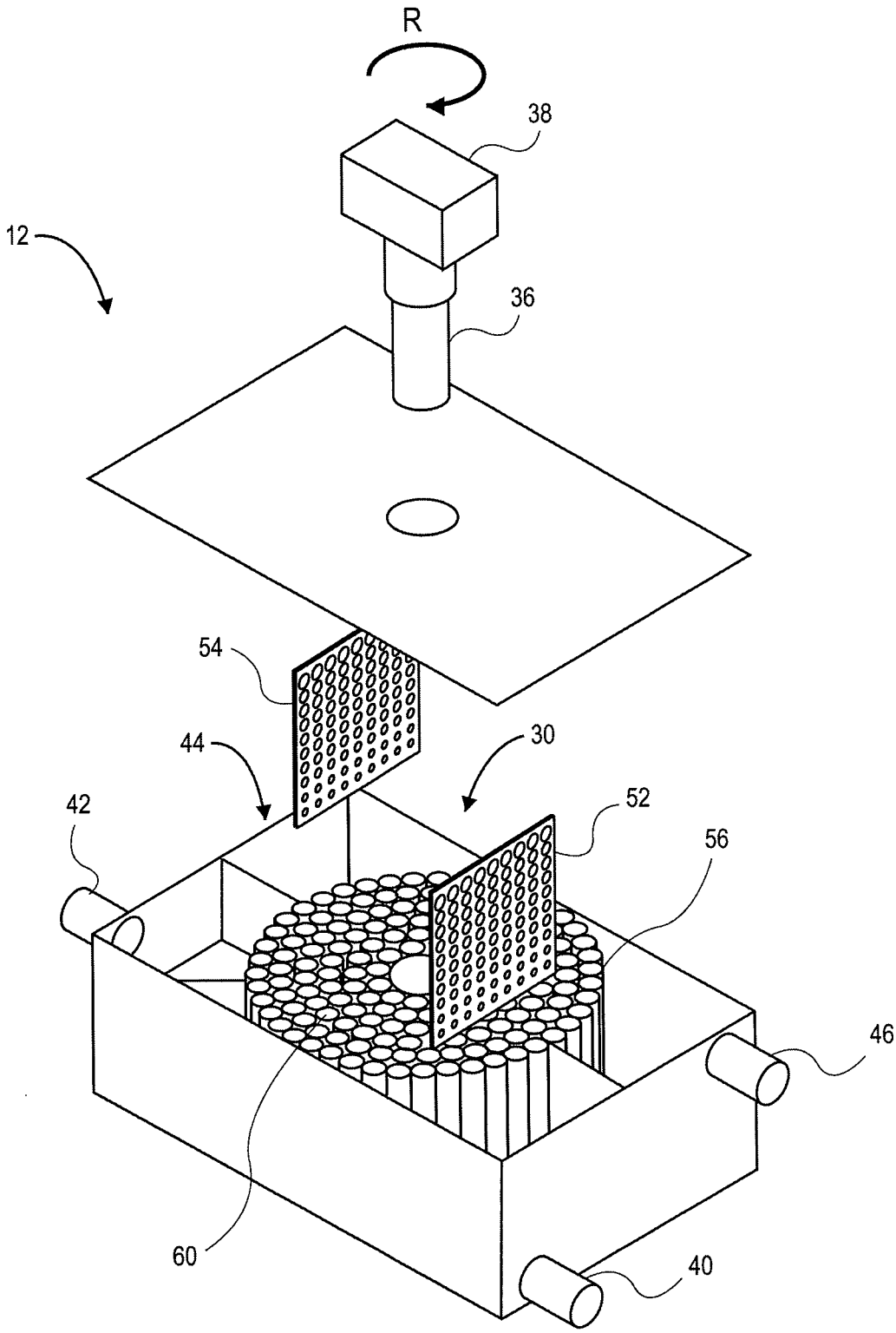
FIG. 8 is an exploded view of a rotary heat exchanger/heat engine system in accordance with yet another embodiment.

FIG. 8 is an exploded view of a rotary heat exchanger/heat engine system 12 in accordance with yet another embodiment. The rotary heat exchanger/heat engine system 12 according to FIG. 8 is similar to the rotary heat exchanger/heat engine system 12 shown in FIGS. 1-7 and thus, for the purpose of brevity, those elements already described hereinabove will not be described again. In general, the rotary heat exchanger/heat engine system 12 of this embodiment differs from the embodiments of FIGS. 1 and 7 in that the cylindrical rotary heat exchanger 28 is arranged perpendicular to the flow of fluid flowing therethrough. That is, fluid entering the heat source inlet 40 and heat sink inlet 44 is configured to strike the sides of the plurality of conduits 60. This flow striking the sides of the conduits 60 generates a torque urging the rotary heat exchanger 28 to rotate in direction R.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for generating power from a low grade heat source, the system comprising:

a heat source inlet to convey a flow of a heated fluid to the system;

a heat sink inlet to convey a flow of a cooled fluid to the system;

a heat exchanger unit configured to rotate, wherein a portion of the heat exchanger unit alternates between conveying the heated fluid and conveying the cooled fluid to cyclically heat and cool the portion of the heat exchanger in response to being rotated; and a heat engine configured to generate energy in response to the cyclic heating and cooling caused by the rotation of the heat exchanger unit.

2. The system according to claim 1, further comprising:

a metal hydride compressor disposed within the heat exchanger unit and configured to generate a flow of hydrogen in response to the heat exchanger unit being rotated; and a motor configured to rotate a shaft in response to the flow of hydrogen.

3. The system according to claim 1, further comprising:

a set of turning vanes, at least a portion of the set of turning vanes being disposed in the flow of heated fluid and a remaining portion of the set of turning vanes being disposed in the flow of cooled fluid, the set of turning vanes being configured to impart an angular momentum upon the heat exchanger unit sufficient to urge the heat exchanger unit to rotate.

4. The system according to claim 3, further comprising:

a diffuser ring disposed adjacent to the heat exchanger unit, the diffuser ring having a plurality of holes disposed therethrough, a portion of the plurality of holes being configured to direct the flow of heated fluid from the heat source inlet towards the heat exchanger unit, the turning vane being disposed within a hole of the plurality of holes.

5. The system according to claim 4, wherein a second portion of the plurality of holes being configured to direct the flow of cooled fluid.

6. The system according to claim 4, further comprising:

a distribution bell disposed between the heat source inlet and the diffuser ring.

7. The system according to claim 6, further comprising:

a second distribution bell disposed between the heat sink inlet and the diffuser ring.

8. The system according to claim 1, further comprising:

a plurality of conduits disposed about a perimeter of the heat exchanger unit.

9. The system according to claim 1, further comprising:

a sterling engine, disposed within the heat exchanger unit and configured to generate mechanical work in response to the heat exchanger unit being rotated.

10. The system according to claim 1, further comprising:

a thermoelectric generator, disposed within the heat exchanger unit and configured to generate electricity in response to the heat exchanger unit being rotated.

11. The system according to claim 2, further comprising:

a generator powered by rotation of the shaft.

12. The system according to claim 1, wherein the system is disposed between a condenser of a power plant and a heat removal device of the power plant.

13. A power plant having a system for generating power from a low grade heat source, the system comprising:

a heat source inlet to convey a flow of a heated fluid into the system;

a heat sink inlet to convey a flow of a cooled fluid into the system;

a heat exchanger unit configured to rotate, wherein a portion of the heat exchanger unit alternates between conveying the heated fluid and conveying the cooled fluid to cyclically heat and cool the portion of the heat exchanger in response to being rotated; and a heat engine configured to generate energy in response to the cyclic heating and cooling caused by the rotation of the heat exchanger unit.

14. The power plant according to claim 13, further comprising:

a metal hydride compressor disposed within the heat exchanger unit and configured to generate a flow of hydrogen in response to the heat exchanger unit being rotated; and a motor configured to rotate a shaft in response to the flow of hydrogen.

15. The power plant according to claim 13, further comprising:

a set of turning vanes, at least a portion of the set of turning vanes being disposed in the flow of heated fluid and a remaining portion of the set of turning vanes being disposed in the flow of cooled fluid, the set of turning vanes being configured to impart an angular momentum upon the heat exchanger unit sufficient to urge the heat exchanger unit to rotate.

16. The power plant according to claim 15, further comprising:

a diffuser ring disposed adjacent to the heat exchanger unit, the diffuser ring having a plurality of holes disposed therethrough, a portion of the plurality of holes being configured to direct the flow of heated fluid from the heat source inlet towards the heat exchanger unit, the turning vane being disposed within a hole of the plurality of holes.

17. The power plant according to claim 16, wherein a second portion of the plurality of holes being configured to direct the flow of cooled fluid.

18. The power plant according to claim 16, further comprising:

a distribution bell disposed between the heat source inlet and the diffuser ring.

19. The power plant according to claim 18, further comprising:

a second distribution bell disposed between the heat sink inlet and the diffuser ring.

20. The power plant according to claim 13, further comprising:

a plurality of conduits disposed about a perimeter of the heat exchanger unit.

21. The power plant according to claim 13, further comprising:

a thermoelectric generator, disposed within the heat exchanger unit and configured to generate electricity in response to the heat exchanger unit being rotated.

22. The power plant according to claim 13, further comprising:

a sterling engine, disposed within the heat exchanger unit and configured to generate mechanical work in response to the heat exchanger unit being rotated.

23. The power plant according to claim 14, further comprising:

a generator powered by rotation of the shaft.

24. The power plant according to claim 13, wherein the system is disposed between a condenser of a power plant and a heat removal device of the power plant.

25. A heat exchanger comprising:

a heat source inlet to convey a flow of a heated fluid to the heat exchanger;

a heat sink inlet to convey a flow of a cooled fluid to the heat exchanger; and a plurality of conduits disposed about a central axis of the heat exchanger, the plurality of conduits being configured to rotate in unison about the central axis, wherein each of the plurality of conduits alternate between conveying the heated fluid and conveying the cooled fluid to cyclically heat and cool each of the plurality of conduits in response to being rotated and wherein the plurality of conduits are configured for thermal contact with a heat engine configured to generate energy in response to the cyclic heating and cooling caused by the rotation of the plurality of conduits.

26. The heat exchanger according to claim 25, further comprising:

a metal hydride compressor disposed at a central chamber of the plurality of conduits and configured to generate a flow of hydrogen in response to the plurality of conduits being rotated; and a motor configured to rotate a shaft in response to the flow of hydrogen.

27. The heat exchanger according to claim 25, further comprising:

a set of turning vanes, at least a portion of the set of turning vanes being disposed in the flow of heated fluid and a remaining portion of the set of turning vanes being disposed in the flow of cooled fluid, the set of turning vanes being configured to impart an angular momentum upon the heat exchanger unit sufficient to urge the heat exchanger unit to rotate.

28. The heat exchanger according to claim 27, further comprising:

a diffuser ring disposed adjacent to the heat exchanger unit, the diffuser ring having a plurality of holes disposed therethrough, a portion of the plurality of holes being configured to direct the flow of heated fluid from the heat source inlet towards the heat exchanger unit, the turning vane being disposed within a hole of the plurality of holes.

29. The heat exchanger according to claim 28, wherein a second portion of the plurality of holes being configured to direct the flow of cooled fluid.

30. The heat exchanger according to claim 28, further comprising:

a distribution bell disposed between the heat source inlet and the diffuser ring.

31. The heat exchanger according to claim 30, further comprising:

a second distribution bell disposed between the heat sink inlet and the diffuser ring.

32. The heat exchanger according to claim 25, further comprising:

a thermoelectric generator, disposed within the heat exchanger unit and configured to generate electricity in response to the heat exchanger unit being rotated.

33. The heat exchanger according to claim 25, further comprising:

a sterling engine, disposed within the heat exchanger unit and configured to generate mechanical work in response to the heat exchanger unit being rotated.

34. The heat exchanger according to claim 26, further comprising:

a generator powered by rotation of the shaft.

35. The heat exchanger according to claim 25, wherein the system is disposed between a condenser of a power plant and a heat removal device of the power plant.

* * * * *